United States Patent [19]

Robjent et al.

[11] Patent Number: 4,553,767

[45] Date of Patent: Nov. 19, 1985

[54] ROLLER SKATE WITH INTEGRAL RATCHET MEANS

[75] Inventors: Frederick B. Robjent, Orchard Park, N.Y.; Reuben B. Klamer, La Jolla, Calif.

[73] Assignee: The Quaker Oats Company, Chicago, Ill.

[21] Appl. No.: 578,473

[22] Filed: Feb. 9, 1984

[51] Int. Cl.[4] ..... A63C 17/14

[52] U.S. Cl. ..... 280/11.21; 74/578; 188/82.3; 188/82.4

[58] Field of Search ..... 74/578; 188/82.1, 82.3, 188/82.4, 82.7; 280/11.21

[56] References Cited

U.S. PATENT DOCUMENTS

| | | | |
|---|---|---|---|
| 296,833 | 4/1884 | Hanlon | 280/11.21 |
| 363,716 | 5/1887 | Yost | 280/11.21 |
| 864,334 | 8/1907 | Pilz | 280/11.21 |
| 892,758 | 7/1908 | McLay | 280/11.21 |
| 1,974,152 | 9/1934 | Draws | 280/11.21 X |
| 2,165,996 | 7/1939 | Chiles | 280/11.21 X |

*Primary Examiner*—Joseph F. Peters, Jr.
*Assistant Examiner*—Michael Mar
*Attorney, Agent, or Firm*—Cumpston & Shaw

[57] ABSTRACT

A roller skate includes a selectively engagable ratcheting plate that can be positioned for engaging a plurality of teeth formed integrally in one or more wheels of the skate. The plate rides on a cam that is slidably positioned for selective racheting or freewheeling operation. In the ratcheting mode the skate is prevented from rolling backwards thereby making it easier for a beginning skater to use.

9 Claims, 5 Drawing Figures

ROLLER SKATE WITH INTEGRAL RATCHET MEANS

This invention relates in general to roller skates and more particularly to a skate having a selectably-engagable mechanism for limiting the rotation of one or more wheels thereof to a single direction.

It has long been recognized that the early stages of learning to roller skate are facilitated by providing a skate in which one or more of the wheels is prevented from turning in the rearward direction. By providing such a feature, a beginning skater may more easily learn to stop his forward motion without having to be concerned with the problem of thereafter beginning to roll backwards. Backward motion is considerably more difficult for a beginning skater to control than forward motion and a skate having a forward only mode of operation is known to be useful.

In the past, a number of structures for providing a ratcheting function on one or more wheels of a roller skate have been proposed. For example, J. H. Sheahan, U.S. Pat. No. 1,016,447 discloses a ratchet assembly. A ratchet wheel is attached to one or both of the front wheels of a skate and a pawl is attached to a stationary part of the skate in a position so that it may engage the teeth of the ratchet wheel. More recently, Klamer et al., U.S. Pat. No. 4,334,690 shows a similar arrangement also including a ratchet wheel mounted on one or both of the front wheels of the skate and a pawl attached to a bracket, which bracket is attached to the body of the skate.

Each of the prior art patents is characterized by a separate ratchet wheel attached in some manner to one or both of the front wheels of a skate. The necessity for manufacturing a separate ratchet wheel and assembling it to the wheel increases the complexity, and therefore, the cost of the skate. Further, whatever is attached may become unattached and if the ratchet wheel separates from the wheel, the skate becomes unusable in its ratcheting mode.

Still further, the use of a pivoted pawl having an engaged and disengaged position as shown, for example, in Sheahan, creates the possibility that the pawl could inadvertently flip to its disengaged position during skating activities and thereby be surprisingly rendered ineffective.

In the case of the structure shown in the Klamer patent, the ratchet assembly may be rendered ineffective by physically removing it from the skate which requires disassembly of at least the wheel and axle portion of the skate which may be difficult for a younger user to accomplish and in any case, is inconvenient.

Accordingly, it is an object of this invention to provide a skate selectively switchable between a freewheeling mode in which all of the wheels are free to rotate in either direction and a unidirectional mode wherein at least one and preferably two wheels are inhibited from rotating in a rearward direction.

It is another object of this invention to provide such a skate wherein changing from the one mode to the second mode is easily accomplished without the necessity for disassembling any portion of the skate or even for removing the skate from the feet or shoes.

It is still another object of this invention to provide a skate wherein an unintended change from the unidirectional mode to the bidirectional mode is substantially prevented.

Briefly stated and in accordance with a presently preferred embodiment of this invention, a roller skate is provided having a body portion adapted to be attached to the foot of a wearer, and front and rear axles attached to the body portion, the axles having wheels mounted to the ends thereof. At least the front wheels are characterized by an outer cylindrical rolling portion having a plurality of teeth integrally formed on an inwardly facing circumferential surface thereof. A pawl member having first and second ratchet-engaging portions is mounted to the body of the skate and is movable between first and second positions, a first position wherein the pawl is moved out of engagement with the teeth and the wheels are free to rotate in either direction, and a second position wherein the pawl is biased into engagement with the teeth by its own weight and permits rotation of the wheels in only a single direction.

In accordance with a preferred embodiment of the invention, the pawl member is a generally V-shaped unitary element extending between the front two wheels and having a central opening and a cam follower therein. A camming member extends through the opening for either allowing the pawl to ride in the teeth or for urging the pawl upward and out of engagement with the teeth. A selector tab is attached to the camming member for selecting the unidirectional or bidirectional modes.

The aspects of the invention that are regarded as new are set forth with particularity in the claims. The invention itself together with further objects and advantages thereof may be more readily understood by reference to the following detailed description thereof taken in connection with the accompanying drawing in which:

Figure 1:
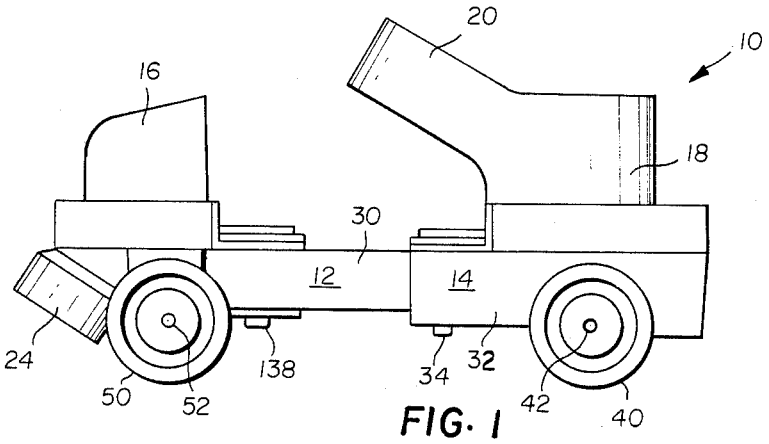
FIG. 1 is a side elevational view of a skate in accordance with this invention FIG 2. is a section view of the front portion of the skate of FIG. 1 showing the components positioned for the unidirectional mode of operation.

Referring now to FIG. 1, a skate 10 is illustrated having a forward body member 12 and a rearward body member 14. Body member 12 includes a cup-shaped toe receiving upper portion 16 for engaging the toe portion of the foot of the wearer or of a shoe or boot worn by the wearer. Body member 14 includes a heel receiving upper portion 18 and a preferably integral strap 20 for securely attaching the shoe or foot of the wearer to the skate. Front and rear foot engaging upper portions 16 and 18 may be made of any flexible or relatively flexible material, such as plastic or leather, and strap 20 is preferably provided with a buckle or other releasable fastening means for allowing the skate to be comfortably adjusted to the foot of the wearer.

Figure 2:
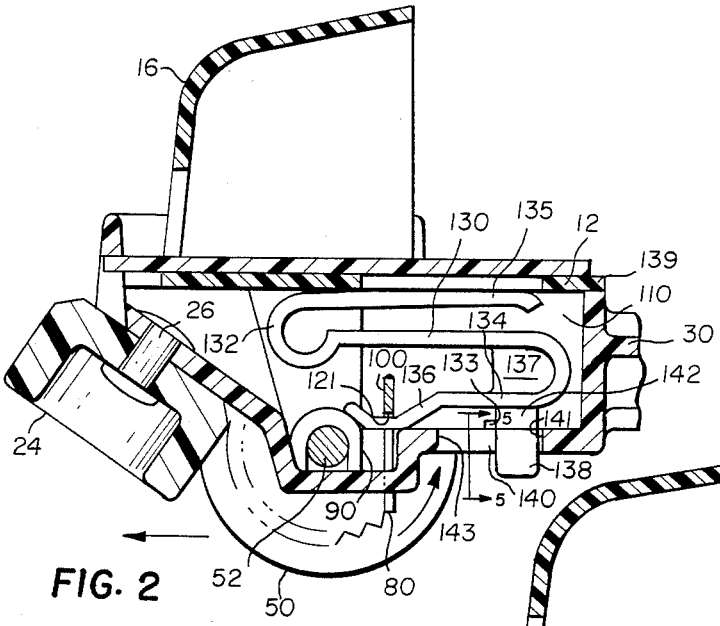

Roller skate 10 may also include a conventional front stop member 24 attached to forward body member 12 by any conventional means such as a screw or rivet 26 or the like as illustrated in FIG. 2.

Preferably, the spacing between front member 12 and rear member 14 of skate 10 is adjustable by providing a rearwardly extending rail portion 30 of front member 12 slidably-engaging a rail receiving portion 32 of rear member 14. Preferably, means such as an adjusting screw or button 34, are provided for releasing the tension between rail 30 and rail receiving portion 32 to allow the spacing between front member 12 and rear member 14 to be adjusted easily, but to maintain preselected fixed relationship therebetween upon release of button 34. It will be appreciated that skates having adjustable spacing are known and as such, this feature of skate 10 forms no particular part of this invention.

Preferably, skate 10 includes a pair of rear wheels 40 attached to an axle 42 that is journaled in a conventional fashion to rear body portion 14 of the skate. A pair of front wheels 50 are attached to front axle 52 as more fully described hereinbelow.

Figure 3:
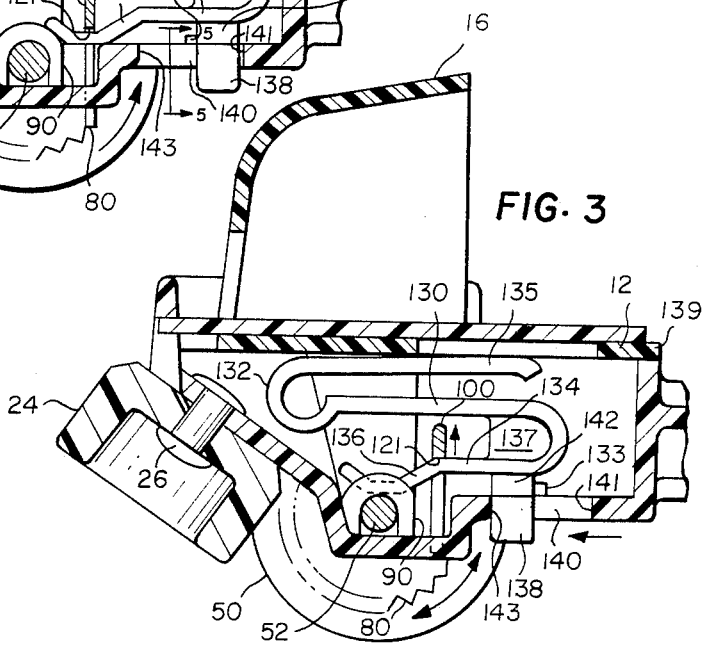
FIG. 3 is a section view similar to FIG. 2, but showing the components positioned for the bidirectional mode of operation.
Figure 4:
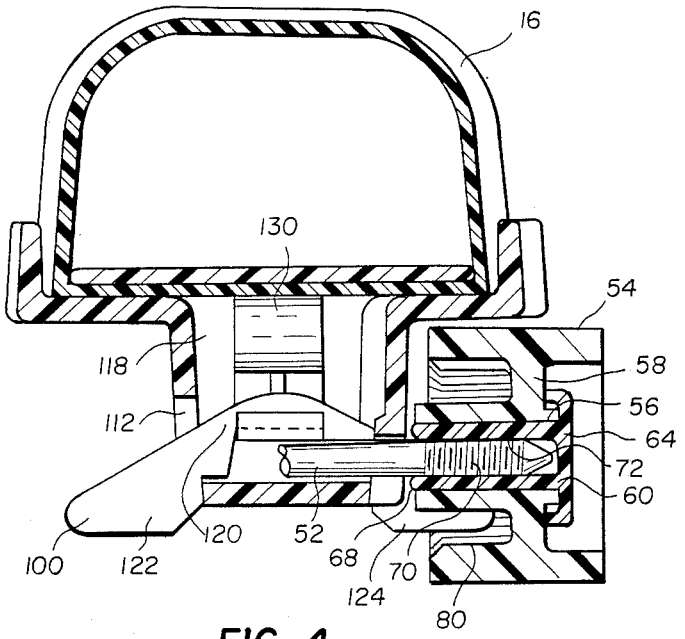
FIG. 4 is another sectional view of the skate of FIG. 1 showing the pawl element.
Figure 5:
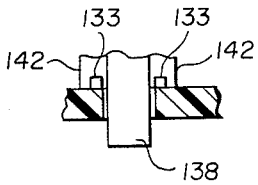
FIG. 5 is a section view taken along line 5—5 of FIG. 4.

The ratcheting action of skate 10 may be more readily understood by referring now to FIGS. 2–4. Wheel 50, as best seen in FIG. 4, includes a cylindrical outer rolling portion 54 and a cylindrical inner portion 56 joined to outer portion 54 by washer-shaped web 58. An axle-engaging bearing member 60, that preferably includes a decorative outer portion 64 and an inwardly-extending cylindrical axle-engaging portion 68, is disposed within inner portion 56 of wheel 50. Preferably, axle 52 is provided with means such as ridges or threads 70 on the surface thereof for providing a close interference fit with inner surface 72 of axle-engaging member 60. The inner cylindrical portion 56 of wheel 50 smoothly rotates on the outer surface of bearing member 60. Preferably, wheel 50 and bearing member 60 are made of compatible plastic materials requiring no lubrication at their bearing surfaces.

The inwardly facing surface of outer cylindrical rolling portion 54 of wheel 50 is provided with a plurality of gear-like teeth 80 integrally formed therewith. In accordance with a presently preferred embodiment of this invention, wheel 50 is constructed of plastic or other suitable material, by molding or the like whereby the wheel can be formed in a single piece. Teeth 80 are preferably molded at the same time, although it will be appreciated that teeth 80 could be cut or otherwise machined into the inner surface of outer cylindrical portion 54 of wheel 50 in a separate operation. Preferably, axle 52 is journaled to forward body portion 12 by bearing 90 which may be integrally formed with forward body portion 12.

Referring now to FIGS. 2–4, the ratcheting action of a pawl 100 and teeth 80 may be readily understood. Front member 12 of skate 10 includes a hollow, generally rectangular inner chamber 110 disposed below and to the rear of upper portion 16. Referring particularly to FIG. 4, chamber 110 has first and second openings 112 and 114 (not visible) through the sidewalls thereof. Substantially V-shaped pawl 100 comprises a central portion 120 and first and second outwardly extend ratchet-engaging wing portions 122 and 124. Wing portion 122 and 124 extending through openings 112 and 114 of chamber 120 and at least partially into the space between inner and outer cylindrical portions 54 and 56 of each of front wheels 50. Central portion 120 of pawl 100 includes cam follower surface 121 that rides on a cam surface 136 of camming member 130 as will be more fully described below.

Combination spring and camming member 130 is slidably disposed within chamber 110. Camming member 130 is substantially S-shaped and includes an upper resilient portion 132 and a lower relatively rigid portion 134 including cam surface 136. The rigidity of lower portion 134 may be enhanced by a web of material 137 disposed in the bend of the lower portion 134. Spring and camming member 130 is preferably made of metal or stiff plastic or the like and includes an actuator tab 138 extending downwardly from member 130 through opening 140 in a lower wall of chamber 110 of forward body portion 12 so as to be accessible to a user of the skate.

Camming member 130 is movable between a rearward position, as shown in FIG. 2, and a forward position, as shown in FIG. 3, by moving actuator tab 138 between first and second stops 141 and 143 within opening 140. In the rearward position as shown in FIG. 2, cam surface 136 of camming member 130 is essentially disengaged from cam follower surface 121 of pawl 100. Wings 122 and 124 ride in ratchet teeth 80 biased into engagement therewith by the weight of pawl 100; and wheels 50 are prevented from rotating in a backwards direction. When tab 138 is moved to a forward position as shown in FIG. 3, cam follower surface 121 of pawl 100 rides up on inclined cam surface 136 of camming member 130 and wings 122 and 124 are moved out of engagement with teeth 80, and wheel 50 is free to rotate in either direction.

Camming member 130 is maintained securely in a selected position by dogs 133 on the bottom wall of chamber 110 that engage projections 142 on the sides of tab 138. To change the position of camming member 130, a user pushes inwardly on tab 138 so that projections 142 clear dogs 133, moves the tab to the desired position and releases the pressure on the tab whereby the member 130 is held securely in a selected position during skating.

A skate is provided in accordance with this invention which implements the desirable unidirectional rolling function in a manner that utilizes a minimum number of separate parts and which rolling function is easily selected or deselected at the option of the user. No separate ratchet wheel is required, and therefore, the possibility that such a wheel may become detached from the wheel or axle of the skate is eliminated.

While the invention has been described in connection with a presently preferred embodiment thereof, certain modifications and changes may occur to those skilled in the art without departing from the true spirit and scope of the invention which is intended to be defined solely by the appended claims.

We claim:

1. A roller skate adapted for selectable unidirectional or bidirectional motion comprising:

a hollow body;

a plurality of wheels attached to said body, at least one of said wheels having a cylindrical rolling portion including an inner surface surrounding a hollow inner chamber;

a plurality of ratchet teeth formed in said surface;

a vertically oriented plate mounted for slidable movement vertically within said body and having pawl means at one end of said plate extending out of said body and at least partially into said chamber; and control means for moving said plate between a first position wherein said pawl means is lowered into engagement with said teeth in a ratcheting manner and a second position wherein said pawl means is raised out of engagement with said teeth.

2. The roller skate of claim 1 wherein said at least one wheel comprises an outer cylindrical portion, an inner cylindrical portion and a washer-shaped web joining said portions.

3. The skate of claim 2 wherein said pawl means extends into the space between said inner and said outer cylindrical portions.

4. The skate of claim 1 wherein said plate comprises a substantially flat V-shaped member having a centrally disposed cam follower surface.

5. The skate of claim 4 wherein said control means includes slidable cam means engaging said cam follower surface for selectably moving said pawl between said first and second positions.

6. The skate of claim 5 wherein said cam means comprises a generally S-shaped member.

7. The skate of claim 6 wherein said cam means further comprises an inclined portion engaging said cam follower surface.

8. The skate of claim 7 wherein said control means further includes selector means attached to said cam means movable between first and second stops for positioning said pawl in said first and second positions.

9. The skate of claim 8 further comprising detent means for maintaining said cam means in said preselected position.

* * * * *